United States Patent [19]

Wester

[11] 4,034,979

[45] July 12, 1977

[54] WEIGHTED BOWLING GLOVE

[76] Inventor: Lewis H. Wester, 6030 Sherry Lane, Dallas, Tex. 75225

[21] Appl. No.: 605,252

[22] Filed: Aug. 18, 1975

[51] Int. Cl.[2] ..... A63D 5/00

[52] U.S. Cl. ..... 273/54 B; 2/161 A; 272/119

[58] Field of Search ..... 273/54 B; 2/161 A; 272/67, 80, 81, 119; 301/5 B

[56] References Cited

U.S. PATENT DOCUMENTS

| | | | |
|---|---|---|---|
| 2,011,362 | 8/1935 | Hayward | 273/54 B X |
| 2,029,132 | 1/1936 | Skelton | 301/5 B |
| 2,949,610 | 8/1960 | Lutsky | 273/54 B UX |
| 3,117,786 | 1/1964 | Anderson | 273/54 B |
| 3,149,839 | 9/1964 | Materia | 273/54 B |
| 3,203,006 | 8/1965 | Shirey | 273/54 B X |
| 3,369,258 | 2/1968 | Smith | 273/54 B X |

*Primary Examiner*—Anton O. Oechsle
*Attorney, Agent, or Firm*—Richards, Harris & Medlock

[57] ABSTRACT

A weight glove which positions weights both above and below the metacarpal region of a bowler's free hand. The weights are thus distally located on the hand of the bowler's free arm and are particularly weighted to counterbalance the one-sided pull of the bowling ball. The weights are anatomically shaped to allow the bowler to comfortably use his gloved hand with the weights in place.

8 Claims, 7 Drawing Figures

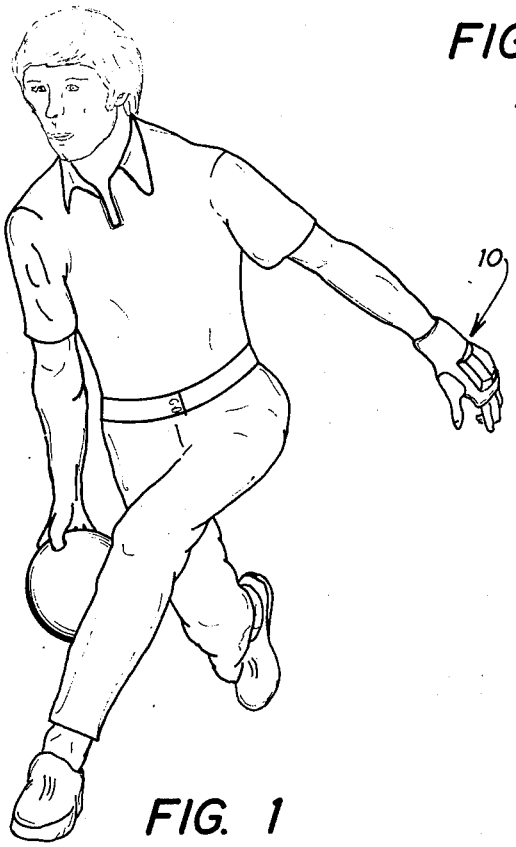
FIG. 1
FIG. 2
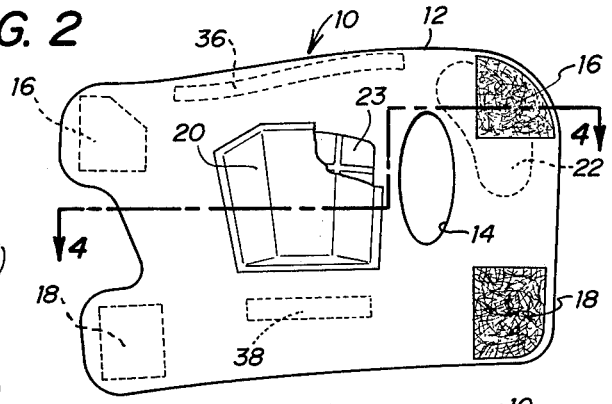
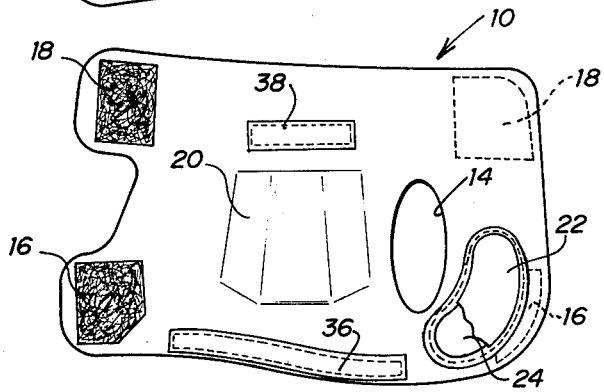
FIG. 3
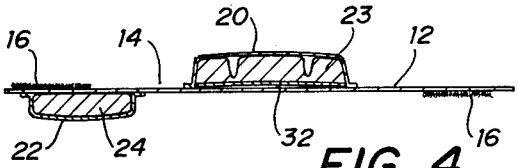
FIG. 4
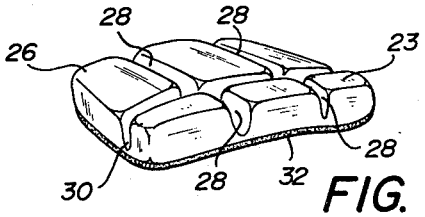
FIG. 5
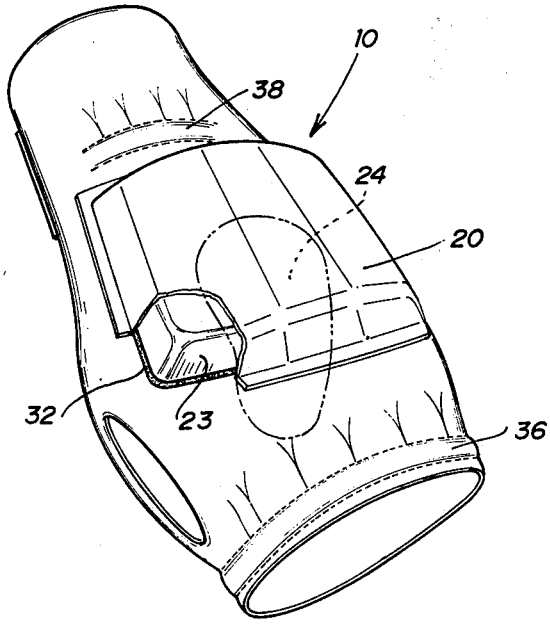
FIG. 7
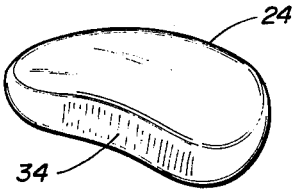
FIG. 6

WEIGHTED BOWLING GLOVE

FIELD OF THE INVENTION

This invention relates to weighted gloves, and more particularly to a glove worn on the free hand of a bowler with weights located both above and below the metacarpal region of the hand.

DESCRIPTION OF THE PRIOR ART

Participants in the sport of bowling are well aware of the imbalance created by the one-sided pull of the bowling ball during its delivery. The arm motion involved in delivering a bowling ball tends to pull the ball-side shoulder downward, and if this shoulder position is not corrected, it interferes with the bowler's accuracy in hitting the target. It is thus well recognized in bowling that accurate delivery of the ball on target is fostered by maintaining the shoulders square at the foul line. It is also known that bowling scores are enhanced by not rushing the foul line, by providing a consistent ball release and by providing firmer slide-foot position at the foul line.

It has heretofore been suggested that the provision of a weight on the bowler's free hand operates to counterbalance the one-sided pull of the bowling ball. Devices embodying this technique are disclosed in U.S. Pat. No. 3,203,006, issued to L. H. Shirey and U.S. Pat. No. 3,149,839, issued to F. S. Materia.

However, some prior glove devices have not been found to be fully effective in forcing a bowler to use proper bowling movements, and have sometimes been somewhat uncomfortable and impractical to wear while bowling. A need has thus arisen for a weight glove which is operable to teach proper bowling techniques. The weight glove must be comfortable to wear, while at the same time placing a correct sized weight as far from the body as possible to serve as a counterbalancing force. For the beginning bowler, such a weight glove would create good bowling techniques much easier and quicker, while for the experienced bowler, the weight glove could be worn to replace undesirable and deeply engrained bowling habits with the proper delivery from, thereby leading to higher scoring and more enjoyment of the game.

SUMMARY OF THE INVENTION

The present invention provides a weight glove which eliminates and reduces the problems heretofore associated with prior art devices. The present weight glove is particularly weighted and configured to be worn by a bowler on his free hand to foster correct bowling techniques by counterbalancing the one-sided shoulder pull of the bowling ball.

In accordance with the present invention, a glove has a plurality of attached weight receiving pockets which are disposed both above and below the metacarpal area of the hand. A first weight is positioned within the weight receiving pocket above the metacarpal region of the hand, while a second weight is positioned below the metacarpal region of the hand. The glove includes a rectangularly shaped piece of material with a slot formed therein for receiving the wearer's thumb, and including structure for removably fastening the glove around the hand. The first and second weights are anatomically shaped to conform to the contour of the wearer's hand.

In accordance with another aspect of the present invention, a glove has two weight receiving pockets attached to it, the first of the pockets positioned over the metacarpal area of the hand and the second of the pockets positioned under this area. A first weight is positioned within the first weight receiving pocket and a second weight is positioned within the second weight receiving pocket. The first weight is anatomically shaped to conform to the contour of the back of the wearer's hand, while the second weight is anatomically shaped to fit the contour of the palm area of the hand. The first weight is a solid weight having a concave surface on one side to conform to the contour of the back of the wearer's hand, with a convex surface formed on the weight's opposite side. The first weight has a pad adhesively affixed to the concave surface pressing against the back of the wearer's hand, while the convex surface is regularly indented to give a waffle like appearance. The second anatomically shaped weight is kidney shaped, with the concave surface of the weight opposing the base of the thumb. The glove itself is an essentially rectangular flexible sheet having a slot formed in it for inserting the thumb, with structure for fastening the glove to the wearer's hand.

BRIEF DESCRIPTION OF THE DRAWINGS

For a more complete understanding of the present invention and for further objects and advantages thereof, reference is now made to the following description taken in conjunction with the following drawings:

FIG. 1 is a perspective view of a bowler wearing the preferred embodiment of the present invention on his free hand while delivering a bowling ball at the foul line;

FIG. 2 illustrates a top view of the lefthand version of the preferred embodiment of the invention;

FIG. 3 is a bottom view of the lefthand version of the present invention;

FIG. 4 is a front side view of the lefthand version of the present invention taken along line 4—4 in FIG. 2;

FIG. 5 is a perspective view of the first weight in the preferred embodiment of the invention;

FIG. 6 is a perspective view of the second weight of the preferred embodiment of the invention; and FIG. 7 is a perspective view, partially broken away, of the lefthand version of the preferred embodiment of the invention as it is worn by a bowler.

DESCRIPTION OF THE PREFERRED EMBODIMENT

FIG. 1 illustrates the preferred embodiment of the present weight glove, generally indicated by reference numeral 10, worn on the left hand by a right-handed bowler. The weight glove 10 produces a counterbalancing force on the free hand of the bowler to correct the one-sided pull on the right side caused by the motion of delivering the bowling ball, and to improve other aspects of the bowling delivery.

Referring to FIGS. 2, 3 and 4, the weight glove 10 includes a substantially rectangular sheet of material 12 having a generally elliptical slot 14 formed therethrough for receiving the thumb of the left hand, the free hand of a right-handed bowler. The sheet 12 may be constructed of any suitable material well known to those in the art of making gloves. Porous materials, such as porous types of Naugahyde (trademark), are particularly suited for use as sheet 12 due to the comfort they afford the wearer by allowing air to circulate through the material. The sheet 12 includes a set of Velcro-type fastening pads 16 at the top of the glove, and a second set of Velcro-type fastening pads 18 attached at the bottom of the glove. Velcro-type fastening pads are useful for securely and quickly fastening the wrap around sheet 12 together when it is placed on the hand. The Velcro-type fastener includes a pad with a plurality of exposed fibers suitable for holding the fiber hooks of an opposed pad when pressed together. It will be understood that other suitable fastening structure, such as snaps and buckles, for example, could also be used to secure sheet 12 in place around the wearer's hand.

The weight glove 10 is shown constructed from a sheet of material 12 that is wrapped around a hand of the wearer, but it should be understood that a glove could be constructed utilizing the present inventive concepts in the well known manner covering the hand and having a separate sheath for each finger. The preferred embodiment of the invention shown in FIGS. 2, 3 and 4 has the advantages of being economical to manufacture, comfortable to wear, and quickly put on or taken off by the wearer.

A first weight receiving pocket 20 is affixed to the top side of the sheet 12 so that the weight pocket 20 is positioned over the metacarpal region of the hand when the glove 10 is worn. A second weight receiving pocket 22 is affixed to the opposite side of the sheet 12, so that the weight receiving pocket 22 is positioned below the metacarpal region of the hand on the palm, when the glove 10 is worn.

A first anatomically shaped weight 23 is positioned within the weight receiving pocket 20 and a second anatomically shaped weight 24 is positioned within the second weight receiving pocket 22. The first weight 23, shown more clearly in FIG. 5, includes a convex surface 26 having a waffle configuration formed by regular indentations 28 and a concave surface 30 having a thin flexible pad 32 adhesively affixed to the surface 30. The waffle configuration facilitates the forming of the weight 23 so that it achieves the desired curved anatomical shape. The first weigh 23 is oriented within the first weight receiving pocket so that the concave surface 30 with its pad 32 is adjacent the back of the wearer's hand. The concave surface 30 of the weight 23 conforms to the contour of the back of the wearer's hand, while the pad 32 cushions the hand from the weight to reduce any discomfort in wearing the glove 10. The pad 32 may be constructed of any material useful for cushioning or absorbing shock, such as a ⅛ inch sprip of microfoam plastic. The weight 23 may also be adhesively affixed to the interior surfaces of weight receiving pocket 20 to prevent its movement.

The second anatomically shaped weight 24, shown more clearly in FIG. 6, is kidney shaped. A concave portion 34 of the weight 24 is positioned within the second weight receiving pocket 22 so that it will oppose the base of the thumb when the glove 10 is worn. The weight 24 may also be adhesively affixed within the pocket 22 to prevent its movement. No pad is required to be affixed to second weight 24, since it is adjacent the fleshy surface of the palm of the wearer's hand.

The weights 23 and 24 may be formed from lead in molds to create the desired anatomical shapes. The weight 23 with regular indentation 28 may be inserted in a lead press to create the desired concave-convex shape to conform more readily to the contour of the hand.

In order to be effective for an adult bowler of ordinary size, it has been found that the combined weight of the first weight 23 and the second weight 24 should be at least 24 ounces. Due to many variables, including the weight of the bowling ball used and the level of experience of the bowler, it has been found desirable to vary the combined weight from the minimum of 24 ounces upwards to 36 ounces. A weight greater than 36 ounces is generally not necessary to create the proper counterbalancing force in the weight glove 10. Children could use a weight glove in such a weight range, but it is understood a lighter weight than 24 ounces may be more comfortable for use by a child. Various combinations of the first weight 23 and the second weight 24 may be used to achieve the desired combined weight. For example, in constructing a weight glove 10 having a combined weight of 32 ounces, the first weight 23 on top of the hand may be provided with a weight of 18 ounces and the second weight 24 on the palm of the hand with a weight of 14 ounces.

The first weight receiving pocket 20 or the second weight receiving pocket 22 may be affixed to the sheet 12 of the weight glove 10 by heat sealing means or sewing the pocket 20 to the glove. In the preferred embodiment of the invention shown in FIGS. 2 and 7, the first weight receiving pocket 20 is affixed by heat sealing means and the second weight receiving pocket 22 is stitched to the underside of sheet 12 of the glove 10. In addition, a first elastic strap 36 is sewn along the top of the glove and a second elastic strap 38 is sewn along the bottom of the glove to provide a proper fit of the glove 10 to the hand.

The weight glove 10 of the present invention improves a bowler's ability to maintain body control while delivering a bowling ball. The particular combination of weights 23 and 24 is swung from the axis of the shoulder some distance from the side of the body in a generally rearward and upward direction, as the bowling ball is swung forward. The moment of the counterbalancing effect is produced by the force of gravity acting on the total mass of weights 23 and 24 at some perpendicular distance from the axis, the moment arm of the force. By distally locating weights 23 and 24 over and under the metacarpal region of the hand, the moment arm is optimized for equalizing the moment of force produced by the bowling ball on the opposite side of the body.

The direct result of the improved body balance created by the weight glove 10 is the player's ability to maintain his equilibrium while approaching the foul line to deliver the bowling ball. This has the desirable additional effect of squaring the bowler's shoulders at the foul line during the instant the ball is released for allowing accurate release of the ball. Use of the glove 10 reduces the tendency to rush the foul line and promotes a more consistent release and follow through with a steadier slide-foot position at the foul line. The long accepted good bowling technique promoted by use of the weight glove 10 can give every type of player a more accurate and consistent delivery of the ball on target, which is the object of the game. Participants in the sport of bowling for recreational purposes or for physical exercise will find learning good bowling technique easier by use of the present invention.

Although the preferred embodiment of the invention has been illustrated in the accompanying drawings and described in the foregoing detailed description, it will be understood that the invention is not limited to the embodiment disclosed, it is capable of numerous rearrangements, modifications, and substitutions of materials and elements without departing from the spirit of the invention.

What is claimed is:

1. A weight glove to be worn on a bowler's free hand comprising:

a glove formed from a generally rectangular sheet of flexible material having a slot formed therethrough to accommodate the wearer's thumb;

means for removably fastening said glove to the wearer's free hand;

means for attaching a first anatomically shaped weight to said sheet to position said first weight adjacent the back of the wearer's hand;

means for attaching a second anatomically shaped weight to said sheet to position said second weight adjacent the palm of the wearer's hand;

said attaching means for said first and second weights comprising first and second weight receiving pockets each formed from attaching the edges of a cover sheet extending over the top of each of said weights to the surface of the glove, said second weight being adhesively affixed within said second weight receiving pocket to prevent movement of said second weight in said second pocket, and the combined weights of said first and second weights being sufficient to tend to counterbalance the one-sided pull of the bowling ball on the opposite side of the body during bowling in order to improve the balance of the bowler.

2. The weight glove of claim 1 wherein said sheet is formed from a porous material to allow air to circulate through the glove, and said fastening means comprises cloth gripping pads attached to said sheet.

3. The weight glove of claim 1 wherein said first anatomically shaped weight is a solid weight having a concave surface on one side and a convex surface on the opposite side, whereby said first anatomically shaped weight is positioned by said attaching means so that the concave surface of the weight is opposed to the back of the wearer's hand.

4. The weight glove of claim 3 wherein said convex surface has regular indentations to achieve a waffle-type appearance to thereby facilitate the anatomical shaping to said first weight.

5. The weight glove of claim 3 and further comprising:

a thin layer of padding adhesively affixed to the concave surface of said first weight.

6. The weight glove of claim 5 wherein said padding is adhesively affixed to said first weight receiving enclosure to prevent movement of said first weight in said first pocket.

7. The weight glove of claim 1 wherein said second anatomically shaped weight is kidney shaped and is positioned by said attaching means so that the concave portion of said kidney shaped weight is adjacent the base portion of the thumb.

8. The weight glove of claim 1 wherein said first and second anatomically shaped weights have a combined weight of between 24 ounces and 36 ounces.

* * * * *